US007414018B2

(12) United States Patent
Huff et al.

(10) Patent No.: US 7,414,018 B2
(45) Date of Patent: Aug. 19, 2008

(54) CLEANING PRODUCT

(76) Inventors: Richard M. Huff, 54 Meadowbrook Rd., Franklin, MA (US) 02038; Amy N. Huff, 54 Meadowbrook Rd., Franklin, MA (US) 02038

( * ) Notice: Subject to any disclaimer, the term of this patent is extended or adjusted under 35 U.S.C. 154(b) by 341 days.

(21) Appl. No.: 11/120,507

(22) Filed: May 3, 2005

(65) Prior Publication Data

US 2005/0245415 A1 Nov. 3, 2005

Related U.S. Application Data

(60) Provisional application No. 60/567,206, filed on May 3, 2004.

(51) Int. Cl.
*C11D 17/04* (2006.01)

(52) U.S. Cl. ..... 510/297; 510/281; 510/283; 510/284; 510/295; 510/406; 510/438; 510/439; 8/137

(58) Field of Classification Search ..... 510/281, 510/283, 284, 295, 297, 406, 438, 439; 8/137
See application file for complete search history.

(56) References Cited

U.S. PATENT DOCUMENTS 4,738,792 A * 4/1988 Ertle ..... 8/137
5,765,407 A 6/1998 Choo et al.
5,891,197 A * 4/1999 Young et al. ..... 8/137
5,968,204 A * 10/1999 Wise ..... 8/142
5,972,360 A 10/1999 Braun
6,013,614 A * 1/2000 Mahdessian ..... 510/277
6,180,847 B1 * 1/2001 Ahr et al. ..... 604/367
6,254,692 B1 * 7/2001 Cooper ..... 134/6
6,420,332 B1 7/2002 Simpson
6,576,323 B2 * 6/2003 Wise et al. ..... 428/156

OTHER PUBLICATIONS

Internet printout from http://www.moisttowelettemuseum.com dated Nov. 2, 2005.
Internet printout from http://ithrewup.com/mt/index.htm dated Nov. 2, 2005.
Internet printout from http://www.spwipes.com dated Apr. 29, 2005.
Internet printout from http://www.goophandcleaner.com dated Apr. 29, 2005.
Internet printout from http://madamepaulette.com/EZCart/Stain%20Kit.html dated Nov. 2, 2005.
Internet printout from http://www.circlepackaging.com/Towelette dated Nov. 2, 2005.
Internet printout from http://www.circlepackaging.com/LiquidFill.html dated Nov. 2, 2005.

(Continued)

*Primary Examiner*—Lorna M. Douyon
(74) *Attorney, Agent, or Firm*—Wolf, Greenfield & Sacks, P.C.

(57) ABSTRACT

A product for cleaning stains. In one embodiment, the product may include a piece of material and a volume of carbonated water, both sealed within a container. When a stain is encountered, the container may be opened and the piece of material that has been wetted by the carbonated water may be used to clean the stain.

19 Claims, 3 Drawing Sheets

OTHER PUBLICATIONS

Internet printout from http://www.boneville.net/soda/concept.htm dated Nov. 2, 2005.
Internet printout from http://www.northernbrewer.com/docs/html/corny-keg.html dated Nov. 2, 2005.
Internet printout from http://www.prairiemoon.biz/howtogetmofi.html dated Nov. 2, 2005.
Undated Internet printout entitled "Queen of Clean."
Internet printout from http://www.drugstore.com reflecting Oxi Clean Wipes product, dated Feb. 8, 2005.
Photocopy of packaging from Shout Wipes, no date available.
Photocopy of business card for Diamond Wipes Int'l manager Ramiro Tordillo, no date available.
Photocopy of packaging for European Formula Shampoo, no date available.
Photocopy of packaging for Lula Shimmer Body Lotion, no date available.
Photocopy of packaging for Jaqua On the Go cherry facial scrub, no date available.
Photocopy of packaging for Lula Cherry Facial Scrub, no date available.
Photocopy of packaging for Lula Berry Face Mask, no date available.
Photocopy of packaging for Pleasant Hawaiian Holidays Refreshment Towel, no date available.
Photocopy of packaging for Wood-Ease Premium Tool Wipes, no date available.
Photocopy of packaging for Make-up Remover Wipes, no date available.
Photocopy of packaging for Polynesian Cultural Center, no date available.
Photocopy of packaging for Simple Green All-Purpose Towelettes, no date available.
Photocopy of packaging for Simple Green Heavy Duty Towels, no date available.
Photocopy of packaging for Sunscreen Towelette, no date available.
Photocopy of packaging for Estee Lauder Sunless Towelette, no date available.
Photocopy of McDonalds packaging, no date available.
Photocopy of packaging for Follett's Watch Us Grow Plant Food, no date available.
Photocopy of packaging for Goop Antibacterial Hand Cleaner, no date available.
Photocopy of packaging for Fresh Nap Moist Towelette, no date available.
Photocopy of packaging for Burger King ketchup, no date available.
Photocopy of Hershey packaging, no date available.
Photocopy of packaging for La Spagnola olive oil, no date available.
Photocopy of Tanology packaging, no date available.
Photocopy of packaging for Spwipes, no date available.
Photocopy of packaging for Refresh Glass Cleaning Wipe, no date available.
Photocopy of packaging for Spwipes Kids wipes, no date available.
Photocopy of packaging for Wash'n Dri Moist Disposable Towelette from http://members.aol.com/MoistTwl/gallery/washd-f.gif, no date available.

* cited by examiner

CLEANING PRODUCT

RELATED APPLICATIONS

This application claims priority to U.S. Provisional Application Ser. No. 60/567,206, entitled "Paper-covered foil packet containing carbonated soda water and a non-woven cloth," filed May 3, 2004, which is incorporated by reference herein in its entirety.

BACKGROUND

1. Field of Invention

The invention relates to products for cleaning stains.

2. Related Art

Products for cleaning stains, such as sheets of material (commonly called wipes, napkins or towelettes) impregnated with chemical cleaning solutions, are sometimes sold in individual containers or packets. If a stain is experienced, a consumer can open a packet, remove the material, and use it to blot the stain.

Many consumers prefer to clean stains with a liquid containing gas bubbles, such as carbonated water, which is known to be a good stain remover and does not include potentially odorous and/or irritating chemicals that may leave residue or rings after use. Cleaning stains with carbonated water, however, can be inconvenient. A source of carbonated water (e.g., a bottle or fountain) must be located, and the carbonated water must be brought to the location of the stain and delivered in an appropriate volume. It is not uncommon to accidentally pour a larger than desired volume of carbonated water on a stain, resulting, for instance, in a soaked garment or handbag. Using carbonated water to remove stains can also be dangerous if a glass bottle is used. Glass can shatter, for example, by falling off a table in a restaurant.

SUMMARY

The drawbacks of chemical cleaners, and of delivering carbonated water for cleaning stains from traditional sources such as bottles and fountains, have been appreciated. Aspects of the invention provide a convenient way to deliver carbonated water, together with a piece of material such as a cloth, to a desired location to be used in cleaning a stain.

In one aspect of the invention, a cleaning product includes a sealed container, a piece of material adapted for use in cleaning stains on fabric, and a volume of carbonated water that at least partially wets the material, with the material and the volume of carbonated water disposed within the sealed container.

The container may be a packet (or pouch) of substantially rectangular shape, each side of which is between 1 and 5 inches in length. The packet may be made from two substantially planar sheets, each of which may be made at least partially from foil, sealed around their peripheries. The container may be substantially impervious to gas and liquid, with a pressure inside the container being higher than an ambient pressure outside the container.

The material may be a cloth of substantially rectangular shape, each side of which is between 2 and 24 inches in length. The material may be an absorbent, non-woven cloth that is substantially lint-free.

The carbonated water may be club soda or seltzer, provided in a volume of at least one teaspoon. The volume of carbonated water may be more than the material can absorb, and the product may be configured and dimensioned to permit repeated dipping of the material into the carbonated water.

These and other aspects of the invention will be apparent from the following description.

BRIEF DESCRIPTION OF THE DRAWINGS

Illustrative embodiments of the invention are described below with reference to the following drawings, in which like numerals reference like elements, and wherein.

DETAILED DESCRIPTION

Figure 1:
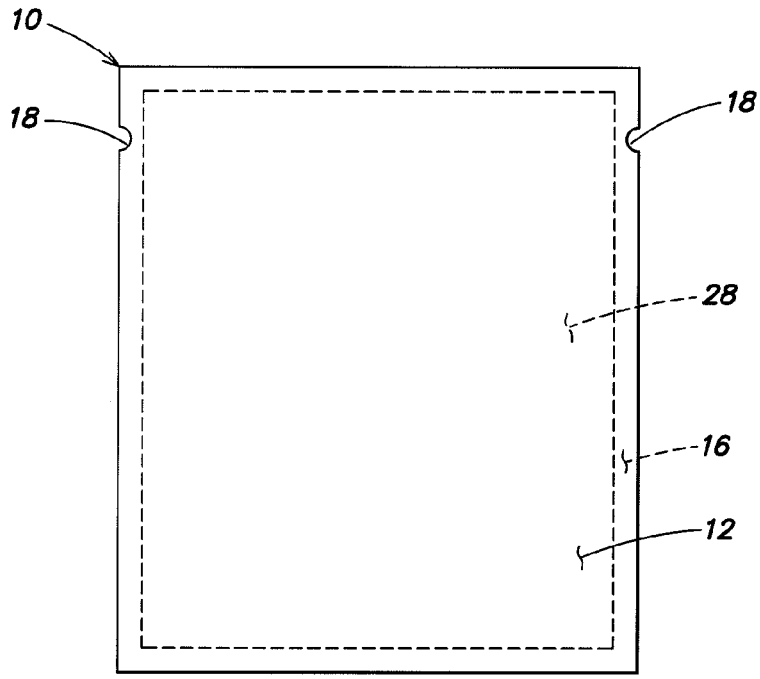
FIG. 1 is a schematic diagram of a container in accordance with one aspect of the invention.

Various aspects of the invention are described below with reference to illustrative embodiments. It should be understood, however, that the invention is not limited to the embodiments described below, but instead may be used in any suitable arrangement.

Aspects of the invention provide a convenient way to deliver carbonated water, together with a piece of material such as a cloth, to a desired location for cleaning a stain. In illustrative embodiments described below, the carbonated water and the material are provided in a single unit. The carbonated water and the material may be provided within a packet, such that the material is at least partially wetted by the carbonated water contained in the packet. In an alternative embodiment, the carbonated water may be provided within a packet and the material may be provided together but outside that packet, such that the material remains dry until wetted by a user. In the latter case, the packet of carbonated water and the material may be packaged together in an appropriate way.

Packaging the material and the carbonated water together is a convenient way of providing a cleaning product to users such as restaurant patrons, without the need to distribute carbonated water from cumbersome bottles or fountains. It is also an attractive alternative to providing chemical-impregnated "towelettes" for cleaning stains. Such chemical-based products can be accompanied by undesirable odors, may cause irritation, and may damage clothing when applied thereto.

As used herein, "carbonated water" refers to water that includes carbon dioxide gas in an amount greater, by at least a marginal amount, than that typically found in common water sources such as tap water or spring water. There is no upper limit on the amount of carbon dioxide gas in "carbonated water" as used herein. The term "carbonated water" includes liquids in which other materials or solutes are present, but does not require the presence of such materials or solutes. By way of example, water containing carbon dioxide and salt is considered "carbonated water," as is water containing carbon dioxide without salt.

As used herein, a "volume" of carbonated water means some amount of carbonated water. This should not be confused with the level of carbonation of the carbonated water, which is sometimes measured in the number of "volumes" of carbon dioxide that are added to a particular "volume" of water. Rather, when a "volume" of carbonated water is mentioned, this is a generic reference to any desired amount of carbonated water that may be used in the product. Particular embodiments, including particular sizes for container 10, may call for use of different volumes of carbonated water in the product, as discussed below.

As used herein, a "stain" refers to any unwanted material such as food, beverages (e.g., wine, coffee, tea or soft drinks), grease, or blood on a surface such as clothing, fabric, carpet or a handbag. The unwanted material need not be "set" on the surface to constitute a stain.

As used herein, to "clean" means to remove some or all of the unwanted material comprising a stain. Not all of such unwanted material needs to be removed for the stain to be considered to have been "cleaned." There is no minimum threshold on what constitutes "cleaning" of a stain; rather, removal of any unwanted material is considered cleaning.

Particular embodiments will now be described with reference to the attached drawing Figures.

FIG. 1 shows a schematic view of a container 10. In this illustrative embodiment, the container 10 is configured as a "packet" constructed from a first sheet 12 and a second sheet 14 (visible in FIG. 3). Sheets 12 and 14 are sealed together at sealing portion 16, which extends around the periphery of sheets 12 and 14 to form a complete seal separating the interior 28 of the container 10 from the atmosphere outside the container 10. Tear nooks 18 are formed in the sealing portion 16 to provide a convenient location at which a user may tear the container 10 open to expose its contents.

Figure 2:
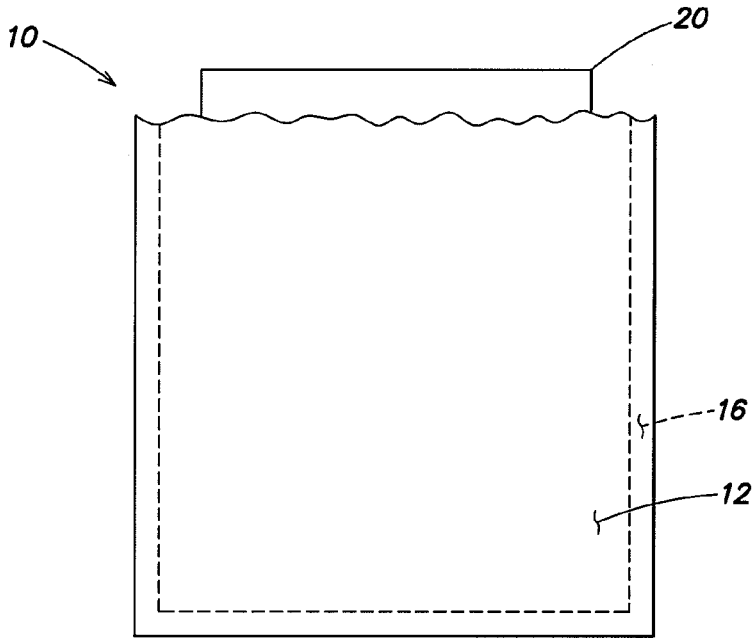
FIG. 2 shows a container that has been opened to expose a piece of material.

FIG. 2 shows a container 10 that has been opened by a user, for example by tearing, exposing a piece of material 20 that was disposed inside container 10.

Container 10 contains, in addition to material 20, a volume of carbonated water that may be applied to stains as discussed in more detail below. In one embodiment, depicted in FIG. 3, the volume of carbonated water is absorbed by, or otherwise wets, material 20. In another embodiment, depicted in FIG. 4, the volume of carbonated water is too great to be absorbed within material 20. Consequently, carbonated water not absorbed by material 20 collects in a pool 22 at the bottom of container 10.

Container 10 may take any suitable form. For example, as noted above, FIGS. 1 and 3 show a container 10 in the form of a "packet" constructed from a first sheet 12 and a second sheet 14. Container 10 may alternatively be a jar, can, bottle or another suitable item identifiable by one of skill in the art for retaining material 20 and a volume of carbonated water. Container 10 may be sealable so as to retain carbon dioxide gas within the volume of carbonated water during the shelf life of the product. The shelf life of the product may be determined based on commercial considerations, but may be any length of time, including one year or longer or one day or shorter.

Figure 3:
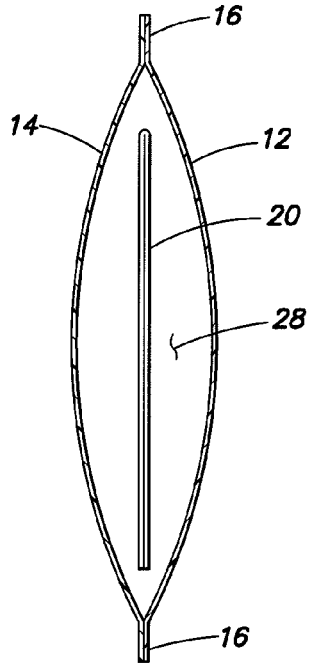
FIG. 3 is a side cutaway view of a container with a piece of material inside.

When container 10 is provided in the form of a packet as shown in FIGS. 1 and 3, it may be substantially rectangular in shape, but may also have any other appropriate shape such as a triangle, square or circle. Other regular or irregular shapes may also be used. The shape of container 10 may be chosen for aesthetic reasons.

In the embodiment shown in FIGS. 1 and 3, container 10 is formed by joining two substantially planar sheets 12 and 14 at a sealing portion 16 around their periphery. Sealing portion 16 may be sealed in any appropriate manner known in the art, for example by heat, pressure, welding, and/or adhesive. Container 10 may alternatively be formed from a single sheet as discussed in more detail below with reference to FIG. 6. Container 10 may also be formed from more than two sheets as one of skill in the art will recognize.

Sheets 12 and 14 may comprise any appropriate material, including foil, paper, paper-coated foil, plastic, or plastic-coated foil, among others. Once sealed, container 10 may be substantially impervious to liquid and/or gas so as to retain sufficient carbonation of the water, and to prevent contamination of the interior portion 28 of container 10. The pressure inside container 10 may be (but need not necessarily be) higher than the ambient pressure outside container 10. For example, the pressure inside container 10 may be between 30 and 90 pounds per square inch (psi), which is approximately the range within which bottlers conventionally pressurize cans of soda containing carbon dioxide gas. The pressure inside the container may also be less than 30 psi or greater than 90 psi. As previously noted, the water will be considered "carbonated" if it contains even marginally more carbon dioxide than that typically found in common water sources such as tap water or spring water. When a relatively small amount of carbon dioxide is provided in the water, the pressure inside the container may be considerably less than 30 psi. The amount of carbon dioxide in the water at the time the product is used need not be the same amount that was present at the time the product was manufactured. Similarly, the pressure inside the container need not be the same at the time the product is used as it was at the time the product was manufactured.

Figure 6:
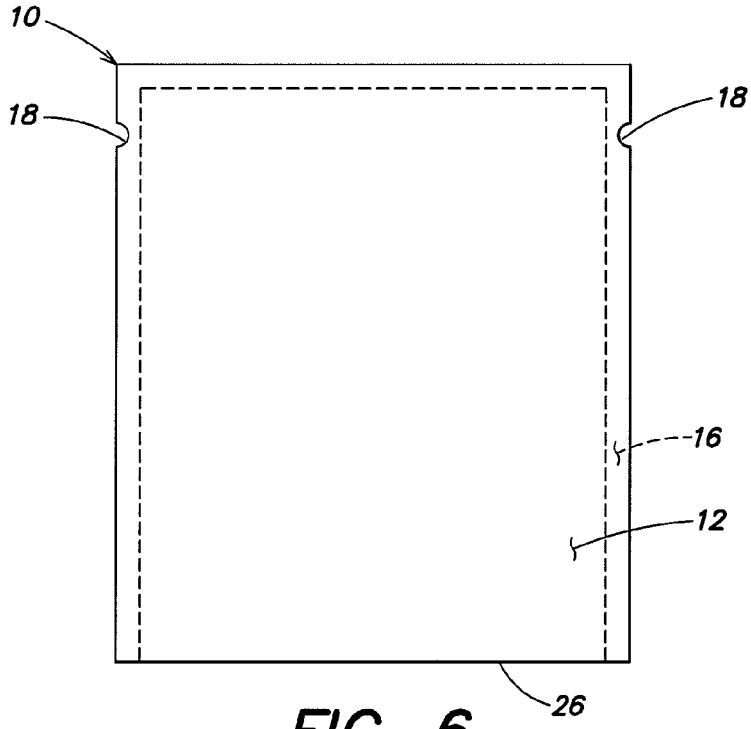
FIG. 6 is a schematic diagram of an embodiment of a container manufactured by folding a sheet on one side and sealing the remaining three sides.

In an alternative embodiment shown in FIG. 6, container 10 may be formed from a single sheet 12 without the need to join a second sheet 14. As depicted in FIG. 6, sheet 12 is folded in half at fold 26, which then forms a natural seal along one side of container 10. The other three sides of container 10 may still be sealed along sealing portion 16 in any conventional manner as discussed above. As noted above, the invention is not limited to a "packet" construction for container 10. Moreover, when a packet-type construction is used, the invention is not limited to one sheet folded in one location or two sheets sealed around their peripheries. As one of skill in the art will recognize, a packet may be constructed in a number of different ways, from varying numbers of sheets and with varying numbers of folds. Aesthetic considerations and manufacturing considerations may influence the way in which the packets are formed.

Figure 5:
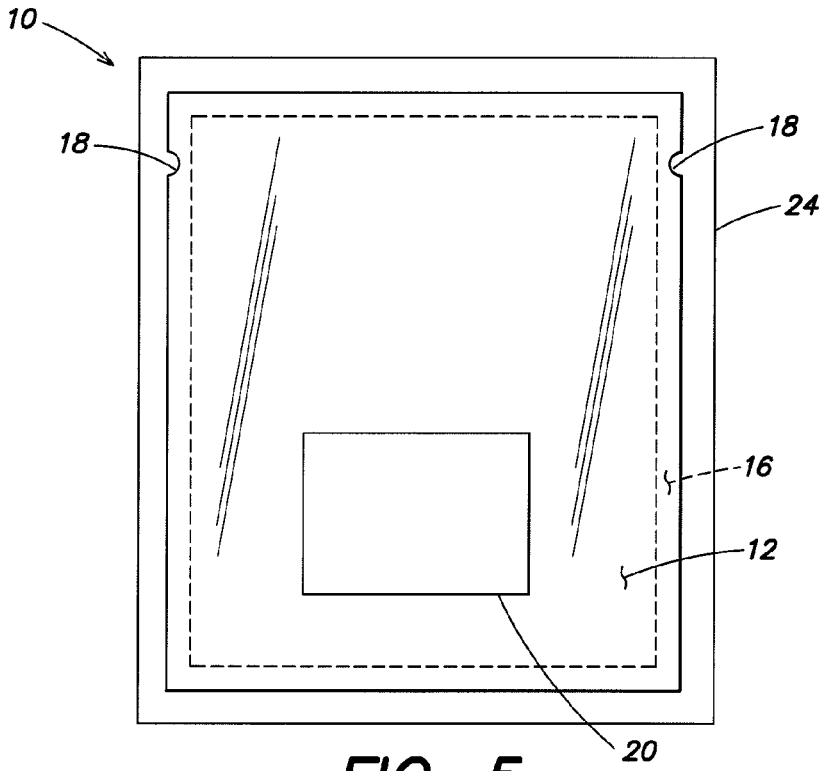
FIG. 5 is a schematic diagram of an embodiment of a container of carbonated water, packaged together with a piece of material disposed outside the container.

In yet another embodiment, shown in FIG. 5, material 20 is not provided within container 10. In such an embodiment, material 20 and container 10 (in which carbonated water is disposed) may still be packaged as a single unit, for instance within a sheath 24. Sheath 24 may be made of any appropriate material, including a transparent or translucent material such as plastic that enables a user to see container 10 and material 20.

The carbonated water used in the present invention may take many different forms. For example, as noted above, salts may or may not be included in the water. In one embodiment, the carbonated water contains the constituent components of standard seltzer water. In another embodiment, the carbonated water contains the constituent components of standard club soda. In a further embodiment, the carbonated water contains potassium bicarbonate and/or potassium sulfate. In yet another embodiment, the carbonated water contains citric acid.

The volume of carbonated water provided in container 10 may also vary. In one embodiment, at least one teaspoon of carbonated water is provided inside container 10. In another embodiment, a volume of carbonated water that can be absorbed by an absorbent material 20 is provided. This volume will naturally depend on the size and absorbency of the material 20 that is used. In yet another embodiment (referred to above and shown in schematic form in FIG. 4) a volume of carbonated water that is too great to be absorbed by material 20 is provided. In general, the volume of carbonated water provided is bounded by the inside volume of the container 10. Preferably, the volume of carbonated water is sufficiently less than the inside volume of the container 10 such that the carbonated water does not spill when container 10 is opened. In another embodiment, however, the inside volume of container 10 may be substantially filled with carbonated water.

The size of the various components may also vary. For example, where container 10 takes the form of a substantially rectangular packet as shown in FIG. 1, the sides of the packet may each be between 1 and 5 inches in length. In a currently preferred embodiment, container 10 is a substantially rectangular packet with sides of approximately 4 inches and 2.5 inches in length. In other embodiments, however, the sides of the packet may be less than 1 inch in length or greater than 5 inches in length. For example, it may be desirable to provide a greater volume of carbonated water and/or a larger piece of material 20, requiring a substantially larger packet with one or more dimensions over 10 inches, over 20 inches, or even greater.

As noted above, material 20 may be substantially rectangular in shape, with sides between 2 and 24 inches in length. In a currently preferred embodiment, material 20 is substantially rectangular in shape, with sides approximately 7 and 9 inches in length. In other embodiments, however, material 20 need not be rectangular in shape (it can be triangular, circular, square or any other regular or irregular shape) and its dimensions may be less than 2 inches or greater than 24 inches. For example, it may be desirable to provide a larger piece of material, with one or more dimensions over 24 inches, over 48 inches, or even greater.

Material 20 may take a variety of forms. In one embodiment, material 20 is absorbent so that it can absorb the carbonated water and apply the same to a stain. Absorbency is also advantageous to facilitate lifting of unwanted material comprising a stain, e.g. from a fabric. However, material 20 need not have any particular degree of absorbency and, indeed, need not necessarily be absorbent at all.

Material 20 may be a cloth, napkin, towelette or any other suitable fabric or substance. It may be woven or non-woven, although a non-woven cloth is preferred. It is also preferred (although not required) that material 20 be substantially lint-free so that particulate matter or shreds of material 20 are not left behind after a stain is rubbed. Material 20 may be folded in any appropriate manner to fit within container 20. One, two, or more folds may be used to fold material 20 to a suitable size. The number of folds may also be over 10, over 20, or more. Material 20 may also be a sponge, which may or may not be folded for insertion into container 10.

Material 20 may be of any suitable color. A dark-colored cloth may be used, for example, if dark-colored clothing or fabric has become stained, since any shreds of material 20 left behind will blend in better and will be less noticeable. For the same reason, a light-colored or a white cloth may be used if light-colored or white clothing or fabric has become stained. However, the invention is not limited in this regard, and dark-colored, light-colored or white materials 20 may be used with any stains on any fabrics. This is particularly true when the material 20 is substantially lint-free so that particulate matter or shreds of material 20 are not left behind after a stain is rubbed.

Cleaning a stain generally begins with the removal of excess unwanted material (such as food) from the stain area. The next steps can vary, depending on the particular embodiment in question and the user's preferences. For example, in the embodiment of FIG. 3 (wherein all or substantially all of the carbonated water inside container 10 is absorbed within material 20) the container 10 may be opened (for example by tearing) and the wetted material 20 may be applied directly to the stain. Application of the material to the stain may be accomplished by blotting, wiping or rubbing. In a preferred method, the material is lightly wiped over the stain in a circular motion until the stain fades or disappears. The item is then laundered as usual (in the case of a garment or other item that is subject to laundering).

Other methods are also contemplated. For example, liquid may first be wrung out of the material 20 onto the stain, after which the material is applied to the stain area to soak up the stain and/or the liquid. The material may be blotted against the stain without wiping, or may be rubbed aggressively depending on the user's preferences and the particular stain in question. The stained garment or other item need not necessarily be laundered following cleaning with the product, particularly if the product succeeds in cleaning the stain to a satisfactory degree.

Figure 4:
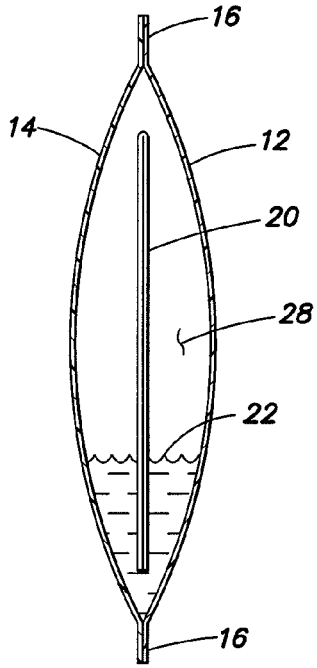
FIG. 4 is a side cutaway view of a container with a piece of material and a volume of non-absorbed carbonated water inside.

In the embodiment of FIG. 4 (wherein at least some of the carbonated water inside container 10 is not absorbed within material 20) the container 10 may be opened (for example by tearing) and the wetted material 20 may be applied directly to the stain (or wrung out over the stain) as discussed above. Because excess liquid is present in the container 10, the material 20 may be dipped back into the liquid and the procedure may be repeated. Alternatively, liquid from container 10 may be poured directly from container 10 onto the stain if desired.

It should be noted that container 10 may comprise one compartment for storage of carbonated water (as shown, for example, in the embodiment of FIG. 3), or may comprise more than one compartment for storage of carbonated water. For example, if two compartments are provided, a user may open a first compartment to access a first volume of carbonated water for use in treating a stain. The second compartment may be opened only if additional carbonated water is desired by the user. Three, four, five or more compartments may also be provided within container 10. Container 10 may also include a separate compartment for storage of material 20 in a dry state. That is, when storage of material 20 separate from the carbonated water is desired, material 20 can be provided in a separate compartment within container 10 rather than providing material 20 outside container 10 as shown in the embodiment of FIG. 5. In another alternative embodiment, material 20 may be provided in one of two or more compartments containing carbonated water. In yet another alternative embodiment, material 20 may be provided in a compartment containing a substance other than carbonated water (such as a cleaning solution), while one or more separate compartments containing carbonated water are provided. In yet a further embodiment, more than one piece of material 20 may be provided. A user may, for example, desire to blot a stain with a first piece of material, then switch to a second piece of material if the first piece of material becomes discolored from the stain. Two, three, four or more pieces of material may be provided. The pieces of material may be provided in a single compartment or in different compartments, either with carbonated water (wet) or without carbonated water (dry). A user may also place one piece of material behind the fabric to be cleaned, to prevent bleeding of the stain through the fabric onto another fabric or a user's skin during cleaning.

The product may be configured for one-time use, or for several uses. For example, if two (or more) compartments are provided for carbonated water, and only one of the compartments is opened by a user, the product may be used again with carbonated water being provided from a previously unopened compartment. Alternatively, container 10 and/or one or more compartments within container 10 may be re-sealable after opening.

The product may be used in restaurants, at home, or in other locations. The product may be provided in any suitable manner. For example, the product may be provided on a restaurant table for use if needed (for example, in sugar caddies, condiment stations or other locations). Alternatively, the product can be stored by the restaurant (in wait staff aprons, in the kitchen or in another location) and provided to patrons on an as-needed basis. The product may be customized in any suitable way, such as with a restaurant's name, address and telephone number as some restaurants currently do with matchbooks. In addition, or alternatively, the product may be branded or co-branded with the logo, name or trademark of a partner company such as the manufacturer of the club soda, seltzer, cloth or other item included in the product.

Use of the product in restaurants may avoid time lag in treating stains, resulting in a higher degree of customer satisfaction Use of the product in restaurants may also provide a marketing advantage to the restaurant, particularly if the product is customized with the restaurant's name, address and telephone number.

The product may be used to similar advantage in a host of other contexts, including on cruises, in airports and on airplanes, and at weddings, parties and other special events.

The product may be manufactured in any suitable manner as will be recognized by one of skill in the art. In one embodiment, sheet material for use in manufacturing packet-type containers like that shown in FIG. 1 is provided on a roll. The sheet is unrolled and placed in tension over a series of spring-loaded rollers. The sheet is passed over a plow assembly where vertical standing packets are formed from the sheet. The side and bottom seals on the packets are formed with heat and pressure, and are cured at a cooling station. Individual packets are then cut. The packets are moved through a series of workstations at which they are expanded with clean, dry air and filled as required (for example, with carbonated water and a piece of material 20). Excess air is then pressed out of the packet, and the top seal area is cleaned and sealed.

For the sake of clarity, and consistent with the preferred embodiment, the term "carbonated water" is employed herein. However, while the preferred embodiment utilizes carbonated water, the invention encompasses liquids other than water and gases other than carbon dioxide. For example, other gases may be used with water without departing from the invention. Similarly, other liquids may be used with carbon dioxide without departing from the invention. Likewise, a liquid other than water and a gas other than carbon dioxide may be used together without departing from the invention.

While illustrative embodiments of various aspects of the invention have been described, the invention is not limited to the embodiments described. Many alternatives, modifications and variations of the embodiments described will be apparent to those skilled in the art. Accordingly, embodiments of the invention as set forth herein are illustrative and not limiting. The invention is limited only by the following claims and equivalents thereto.

What is claimed is:

1. A product for cleaning stains comprising:

a sealed packet of substantially rectangular shape, each side of which is between 1 and 5 inches in length;

an absorbent, non-woven cloth of substantially rectangular shape, each side of which is between 2 and 24 inches in length, the cloth being substantially lint-free and adapted for use in cleaning stains on fabric; and a volume of carbonated water free of chemical-based cleaning products;

wherein the cloth and the volume of carbonated water are disposed within the sealed packet, the volume of carbonated water is more than the cloth can absorb, and a pressure inside the packet is between 30 and 90 pounds per square inch.

2. The product of claim 1, wherein the packet comprises two substantially planar foil sheets sealed around their peripheries.

3. The product of claim 1, wherein the carbonated water is one of club soda or seltzer.

4. The product of claim 1, wherein the volume of carbonated water is at least one teaspoon.

5. The product of claim 1, wherein the cloth is sufficiently wetted to clean stains when applied thereto.

6. The product of claim 1, wherein the packet is substantially gas and liquid impervious.

7. The product of claim 1, wherein a pressure inside the packet is higher than an ambient pressure outside the packet.

8. A product for cleaning stains comprising:

a sealed container;

a piece of material adapted for use in cleaning stains on fabric; and a volume of carbonated water free of chemical-based cleaning products;

wherein the material and the volume of carbonated water are disposed within the sealed container, the volume of carbonated water is more than the material can absorb, and a pressure inside the container is between 30 and 90 pounds per square inch.

9. The product of claim 8, wherein the container is a packet comprising two sides.

10. The product of claim 9, wherein the packet has a substantially rectangular shape, and each side of the packet is between 1 and 5 inches in length.

11. The product of claim 8, wherein the material is a sheet.

12. The product of claim 11, wherein the sheet has a substantially rectangular shape, and each side of the sheet is between 2 and 24 inches in length.

13. The product of claim 11, wherein the sheet is absorbent.

14. The product of claim 11, wherein the sheet is substantially lint-free or a non-woven cloth.

15. The product of claim 11, wherein the sheet is folded.

16. The product of claim 8, wherein the container is substantially liquid impervious.

17. The product of claim 8, wherein the container is substantially gas impervious.

18. The product of claim 8, wherein a pressure inside the container is higher than an ambient pressure outside the container.

19. A method of cleaning a stain, the method comprising:

providing a fabric with a stain;

providing a product for cleaning stains according to claim 8;

opening the sealed container;

removing the material from the container; and applying the material to the stain.

* * * * *